US011141770B2

(12) United States Patent
Fortmeier et al.

(10) Patent No.: US 11,141,770 B2
(45) Date of Patent: Oct. 12, 2021

(54) METHOD FOR PRODUCING A SHAPED SHEET METAL PART PRODUCED BY UO FORMING, AND SHAPED SHEET METAL PART

(71) Applicant: BENTELER AUTOMOBILTECHNIK GMBH, Paderborn (DE)

(72) Inventors: Guenter Fortmeier, Delbrueck (DE); Thomas Henksmeier, Wadersloh (DE); Matthias Koerner, Bielefeld (DE); Aloys Schroeder, Paderborn (DE); Eugen Seibel, Bad Lippspringe (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 334 days.

(21) Appl. No.: 15/941,022

(22) Filed: Mar. 30, 2018

(65) Prior Publication Data

US 2018/0281044 A1 Oct. 4, 2018

(30) Foreign Application Priority Data

Mar. 31, 2017 (DE) ..... 10 2017 106 999.2

(51) Int. Cl.

| | |
|---|---|
| ***B21D 5/10*** | (2006.01) |
| ***B21D 22/02*** | (2006.01) |
| ***C21D 9/00*** | (2006.01) |
| *B21D 19/12* | (2006.01) |

(52) U.S. Cl.

CPC ..... *B21D 22/025* (2013.01); *B21D 5/10* (2013.01); *C21D 9/00* (2013.01); *C21D 9/0068* (2013.01); *B21D 19/12* (2013.01)

(58) Field of Classification Search

CPC ..... B21D 5/10; B21D 5/015; B21D 5/01; B21D 22/025; B21C 37/16; B21C 37/185

See application file for complete search history.

(56) References Cited

U.S. PATENT DOCUMENTS

| | | | | |
|---|---|---|---|---|
| 1,330,782 | A * | 2/1920 | Brown | B21D 5/015 72/368 |
| 2006/0236737 | A1* | 10/2006 | Shitamoto | B21C 37/08 72/51 |
| 2015/0224842 | A1 | 8/2015 | Matsumoto et al. | |

(Continued)

FOREIGN PATENT DOCUMENTS

| | | | |
|---|---|---|---|
| CA | 2962236 | A1 | 4/2016 |
| DE | 10062836 | A | 6/2002 |
| JP | H09141327 | A | 6/1997 |

OTHER PUBLICATIONS

Office Action for Chinese Application No. 201810274624.0 dated Mar. 2, 2020; 9pp.

(Continued)

*Primary Examiner* — Debra M Sullivan

(74) *Attorney, Agent, or Firm* — Hauptman Ham, LLP

(57) ABSTRACT

The disclosure relates to a method for producing a shaped sheet metal part from a billet by UO forming. First, a preform is created by the U-forming. Then, final forming to give a final form is carried out by the O-forming. The preform has in cross section a maximum width that is smaller than the maximum width of the final form produced after the O-forming.

14 Claims, 7 Drawing Sheets

(56) References Cited

U.S. PATENT DOCUMENTS

| | | | | |
|---|---|---|---|---|
| 2017/0274434 | A1* | 9/2017 | Sato | B21C 37/0815 |
| 2018/0021829 | A1* | 1/2018 | Sato | B21D 5/10 428/586 |

OTHER PUBLICATIONS

German Office Action for Application No. 10 2017 106 999.2, dated Mar. 14, 2018, 12 pages.
Office Action for Chinese Application No. 201810274624.0 dated Mar. 29, 2019; 18pp.
Office Action for Chinese Application No. 201810274624.0 dated Sep. 18, 2019; 18 pp.

* cited by examiner 4
5
6
7
8
9
10
11
12
13
14
23
wa)
wd
we
wf
wg
wh)
B5
B11
B13

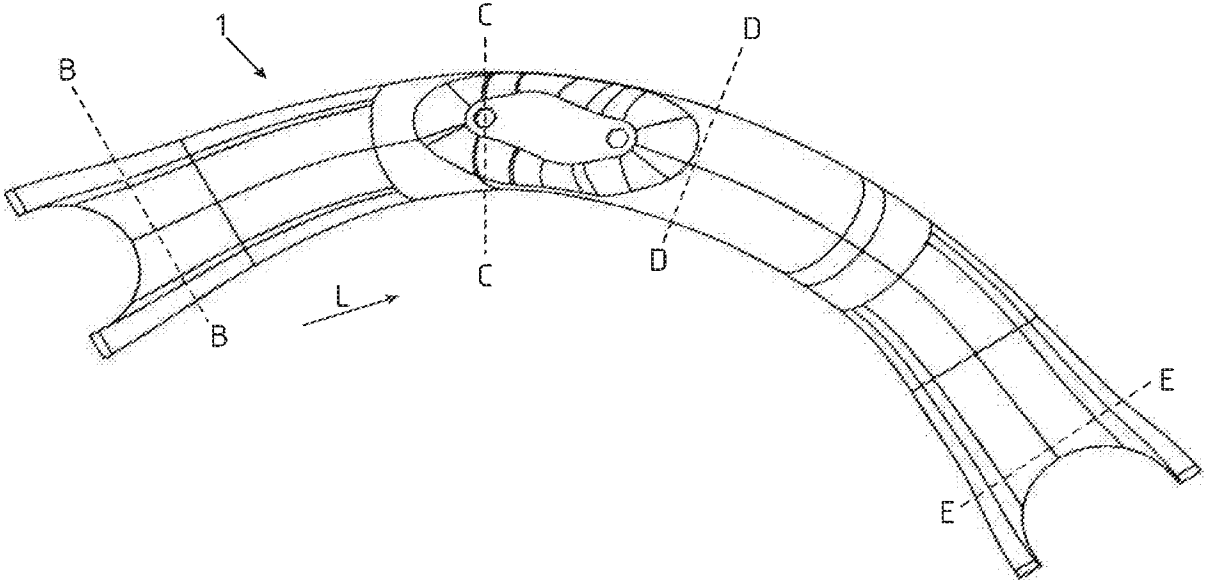
Fig. 6A
Fig. 6B
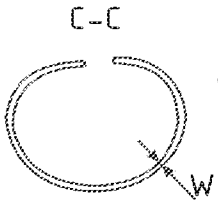
Fig. 6C
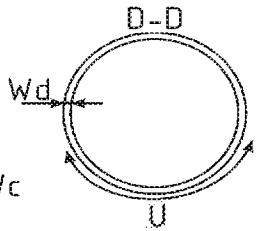
Fig. 6D
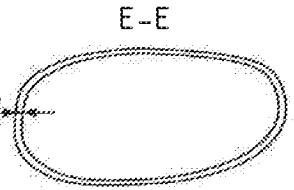
Fig. 6E

METHOD FOR PRODUCING A SHAPED SHEET METAL PART PRODUCED BY UO FORMING, AND SHAPED SHEET METAL PART

RELATED APPLICATIONS

The present application claims priority of German Application Number 10 2017 106 999.2 filed Mar. 31, 2017, the disclosure of which is hereby incorporated by reference herein in its entirety.

FIELD

The present disclosure relates to a method for producing a shaped sheet metal part from a billet by UO forming, and to a shaped sheet metal part.

RELATED ART

It is known from the prior art to produce sheet metal components by shaping. In particular, for this purpose billets of steel alloys or else of light metal alloys are provided and are processed using shaping technology so as to produce a three-dimensionally formed shaped sheet metal part.

In order to produce hollow profile components having a closed cross section, UO forming has become established from the prior art. This involves first producing a preform by U-forming. The U-forming produces a profile component having a half-open cross section. This is followed by O-forming, whereby the cross section is closed and optionally welded.

It is also known from the prior art to produce the UO forming for three-dimensionally complexly formed components. This means that the cross section varies over the length of the component, and the mid-point of the cross-sectional area does not lie essentially on a central longitudinal axis but rather is arranged so as to deviate therefrom. The production of such a three-dimensionally complexly formed UO-formed component is known for example from DE 100 62 836 A1.

SUMMARY

The present disclosure provides one or more embodiments with the object of further increasing the degrees of freedom for shaping during UO forming, while at the same time reducing the production costs.

The method in accordance with some embodiments for producing a shaped sheet metal part from a billet by UO forming provides that first a preform is created by the U-forming. This can be brought about in particular using a deep-drawing process. This produces a preform. The preform is then processed further by the O-forming to give the final form. The final forming can take place in particular in a press-shaping tool having a top tool and a bottom tool.

In particular, the method is used to process a sheet billet which can be made of a steel material or a light metal material. The sheet billet can have a constant wall thickness but can also have local variations in wall thickness.

According to some embodiments of the disclosure, it is now provided that the preform has in cross section a maximum width that is smaller than the maximum width of the final form produced after the O-forming, in the same cross-sectional plane. The disclosure in some embodiments relates in particular to the production of a shaped sheet metal part, hereinafter also referred to as a component, of nonconstant cross section in the longitudinal direction, that is to say a shaped sheet metal part produced with a three-dimensionally complex form. The resulting respective cross sections can also be offset from a central longitudinal axis, thus it is possible to produce a three-dimensionally complex form, for example a funnel curved in the longitudinal direction, or the like.

Thus, in contrast to a conventional UO forming method, it is possible in some embodiments to produce cross-sectional configurations that deviate over the longitudinal direction of the produced component. It is in particular possible in some embodiments for the circumference of the cross section to vary by more than 5% in the case of steel components and by more than 10% in the case of components made of a light metal alloy, in particular an aluminum alloy. The component therefore has a circumference at one cross section and, at a cross section spaced apart therefrom in the longitudinal direction, a circumference that is more than 5% or, respectively, 10% larger or smaller. This markedly increases the shaping possibilities for the UO forming method according to some embodiments of the disclosure.

The method according to some embodiments of the disclosure thus makes it possible, in particular, to produce chassis or structural components for a motor vehicle. It is for example possible to produce side arms, transverse control arms, cross-members, or also towers and longitudinal beams. The above-mentioned components are used in particular in the axle region or in the crash region of the motor vehicles.

According to some embodiments of the disclosure, it is provided in this context that each resulting cross section of the preform has a maximum width that is smaller than the maximum width of the cross section, considered at the same location, of the produced final form. In that context, the final form corresponds to the produced shaped sheet metal part, wherein the shaped sheet metal part can have undergone further processing steps such as longitudinal seam welding, trimming, quenching or the like. The maximum width is in that context in particular the external width, measured as a horizontal, particularly preferably transversely to the press stroke direction of the tool used for final forming.

Alternatively, it is provided according to some embodiments of the disclosure that in at least one length section the width of the cross section of the preform essentially corresponds to the width of the final form. This length section preferably has a length that is between 1% and 10% of the total length of the preform. It is also possible for multiple such length sections to be present, in which the width of the cross section of the preform essentially corresponds to the width of the final form. This measure preferably represents tipping protection since the width of the cross section of the preform, and thus necessarily particularly preferably the cross-sectional configuration in a lower portion of the preform, essentially corresponds to the cross-sectional configuration of the final form in this lower portion. The preform produced in this manner can be placed onto or into a bottom tool for final forming. Sideways tipping of the preform is avoided since those length sections of same width bear in a form-fitting manner against the contour of the bottom tool, thus avoiding the preform tipping in the final forming tool. Particularly preferably, two such length sections are provided on the preform.

According to some embodiments of the disclosure, the method is thus characterized by the fact that the preform produced by U-forming differs markedly from the geometry of the final form, in particular in cross section. This makes it possible to achieve more complex shapings since, in particular, the possibilities during final forming are not yet excessively definitively restricted or influenced by the preforming. The large difference between the cross section of the preform and the cross section of the final form can also be configured just in length sections.

It is in particular provided in some embodiments that the maximum width of the cross section of the preform is at least more than 5%, preferably more than 10%, in particular more than 15% and particularly preferably more than 20% smaller than the maximum width of the cross section of the final form. However, the maximum width in some embodiments is not more than 100% smaller than the maximum width of the final form, preferably not more than 50% and particularly preferably not more than 25%.

The U-forming and the O-forming in some embodiments are particularly preferably carried out in mutually different tools. The preform produced by the U-forming is removed from the preforming tool and is transferred to the final forming tool or an intermediate forming tool. In particular, a preform having at least one curvature in the longitudinal direction is produced, preferably for making an A-pillar.

In a preferred configuration variant of the method according to some embodiments of the disclosure, it can further be provided that a further intermediate forming step is carried out between the U-forming and the O-forming.

The intermediate forming step in some embodiments is in particular processing of the projecting edges produced by the U-forming. These can be first trimmed so as to produce a preform with high dimensional accuracy and/or near-net contour cut. More preferably, the projecting edges can also be bent inward, that is to say oriented toward one another.

The intermediate forming step in some embodiments can also be a curling operation. The curling preferably produces an intermediate form. The intermediate form is in particular different from the preform. In particular, the intermediate form approximates the final form and/or already essentially corresponds, at least in parts, to the final form. In particular, the intermediate forming is carried out by a curling operation.

Preferably, the maximum width of the preform in some embodiments can be increased already at the curling stage, thus establishing a maximum width of the intermediate form. The maximum width of the intermediate form essentially corresponds to and/or at least approximates the maximum width of the final form.

In particular, the intermediate form in some embodiments can be processed such that a lower portion of the cross section, in particular up to a lower quarter, preferably up to a lower third and in particular up to a lower half of the intermediate form already corresponds, in cross section or in cross-sectional configuration, to the final form. This has in particular the advantage that centering takes place when the intermediate form is placed into the final forming tool.

Alternatively or in addition, the intermediate forming step in some embodiments can also involve upsetting of the preform, in particular upsetting of the cross section. In that context, the wall thickness, in particular the wall thickness in the cross section, is increased by the upsetting.

Again, alternatively or in addition, the method according to some embodiments of the disclosure can involve an upsetting operation especially during final forming. In this context, and in particular during the O-forming, the two opposite face sides of the end regions, or end-side edges, come to bear against one another and further closure of the O-forming tool then causes upsetting with the result that, during the final forming, the wall thickness of the produced component is increased.

During the upsetting operations in some embodiments, the wall thickness in the cross section is increased. This can be the case for every cross section, that is to say over the entire length of the component, but can also apply only to certain length sections. For example, it is thus possible to increase only the wall thickness in the respective cross section of a central length section. The wall thickness in the cross section of the outer length sections then remains approximately equal to the wall thickness of the billet used at the beginning.

Upsetting introduces in particular residual stresses—and in this case specifically compressive residual stresses—into the component in some embodiments. This has an inventive advantage whereby compressive residual stresses are introduced such that, when the component is subsequently loaded, in particular in the case of alternating bending stresses, the component has no tendency to crack formation. This effectively avoids, in a crash situation, delayed fracturing and/or tearing-off of a component that is in a vehicle body or is coupled to other components.

Also, in some embodiments, upsetting means that the component is produced with greater dimensional accuracy since it avoids in particular a spring back effect.

Optionally, and in particular when using a quenchable steel alloy in some embodiments, at least the final forming can be carried out as hot-forming with optional subsequent press-quenching. This makes it possible to produce a quenched steel component with high-strength or very-high-strength properties.

When using aluminum alloys in some embodiments, it is also possible to use, for the preforming and/or final forming, a corresponding hot forming or semi-hot forming process known for aluminum alloys. This further improves the forming properties.

Furthermore, for producing the shaped sheet metal part in some embodiments, it is possible to subsequently process the produced final form. In particular, this can for example involve welding together butt-jointed edges.

Furthermore, the present disclosure also relates to a shaped sheet metal part produced according to the UO forming method described herein. The component in some embodiments is characterized on one hand by the fact that it is produced by the method according to some embodiments of the disclosure. On the other hand, the component is characterized in that the wall thickness of a respective cross section varies in the longitudinal direction. Alternatively or additionally, the component is characterized in that it has at least two curvatures, wherein the respective maximum deflections of the curvatures project, oriented in mutually different directions, from a straight line connecting the ends of the component.

BRIEF DESCRIPTION OF THE DRAWINGS

For an understanding of embodiments of the disclosure, reference is now made to the following description taken in conjunction with the accompanying drawings, in which:

FIGS. 6A-6E show the component from FIGS. 5A-5D in a plan view and various cross-sectional views.

In the figures, the same reference signs are used for identical or similar components, even if a repeated description is omitted for reasons of simplicity.

DETAILED DESCRIPTION

Figures 1, 1A, 1B, 1C:
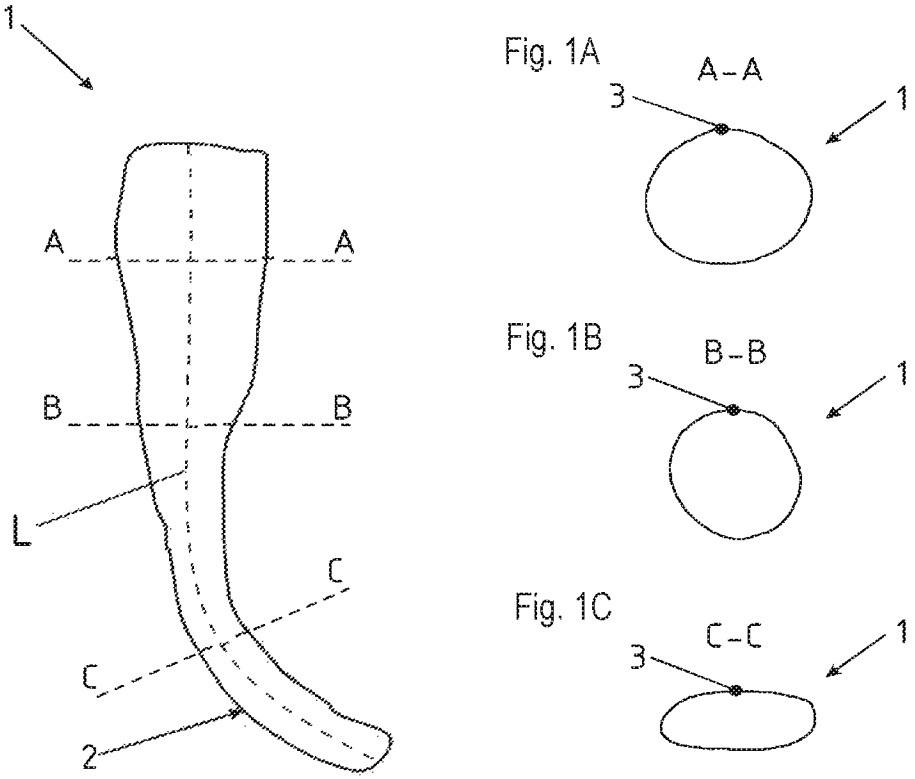
FIGS. 1 and 1A-1C show a shaped sheet metal part, produced according to one or more embodiments of the disclosure, in a side view and cross-sectional representations.

FIG. 1 shows, in a side view, the shaped sheet metal part 1 produced according to some embodiments of the disclosure, and FIGS. 1A-1C show cross-sectional views relate to section lines A-A, B-B, and C-C, respectively. These figures show that the shaped sheet metal part 1 is produced with a three-dimensionally complex form. In that context, it has in particular a curvature 2 in the lower section relating to the plane of the image, that is to say that it is curved in the longitudinal direction L. The respective cross-sectional configurations of the cross sections also vary along the longitudinal direction L of the component 1. Also shown is a weld seam 3 produced in the component 1. The weld seam 3 serves to close the opposing butt edges 6 of the final form 13.

Figures 2A, 2B, 2C, 2D, 2E, 2F, 2G, 2H:
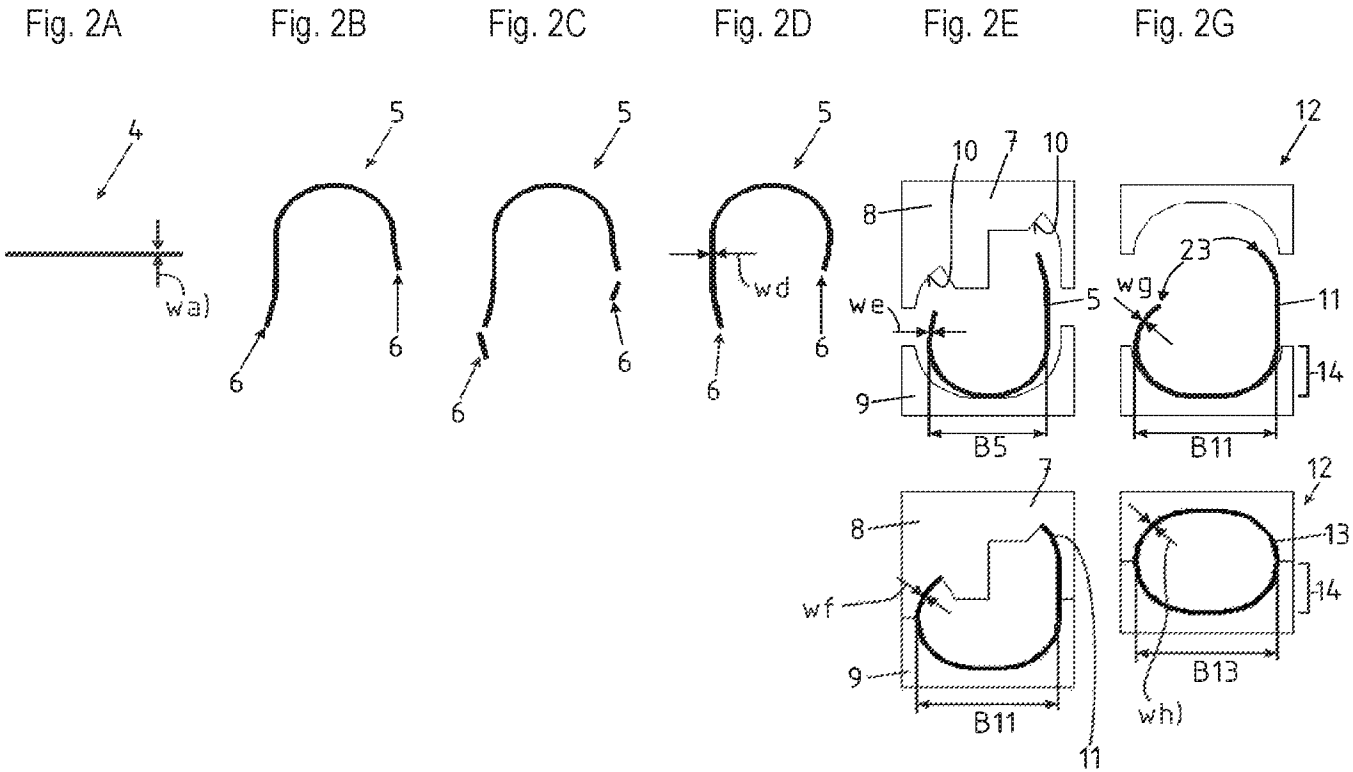
FIGS. 2A-2H show a method sequence according to some embodiments of the disclosure.

The shaped sheet metal part 1 is produced, according to some embodiments of the disclosure, with increased degrees of freedom for shaping and at the same time with lower production costs, the sequence of the method according to some embodiments of the disclosure being illustrated schematically in FIGS. 2A-2H. First, a planar sheet billet 4 as shown in FIG. 2A is made by U-forming into a preform 5. This can be done for example by deep-drawing. The preform 5 is shown in FIG. 2B. The projecting edges 6 can be trimmed in a subsequent intermediate step, which is shown in FIG. 2C. In another intermediate step, shown in FIG. 2D and following the optional preceding trimming, the projecting edges 6 can then be bent inward. To that end, the two edges 6 are bent so as to be oriented essentially toward one another. The preform 5 produced and processed in this manner is then further preferably processed in an intermediate forming tool 7, which is shown in FIGS. 2E-2Ff. First, the preform 5 is, to that end, placed into the intermediate forming tool 7, as shown in FIG. 2E, and then the intermediate forming tool 7 is closed, which is shown in FIG. 2F. To that end, a top tool 8 and a bottom tool 9 of the intermediate forming tool 7 are moved toward one another. In particular, to that end centering edges 10 are provided on the top tool 8 of the intermediate forming tool 7, so that the projecting edges 6 of the preform 5 come to bear against the centering edges 10. In so doing, a width B5 of the preform 5 is also widened to a width B11 of the intermediate form 11.

The produced intermediate form 11 is then, as shown in FIG. 2G, placed into a final forming tool 12 and shaped into the final form 13 by closing the final forming tool 12. The final forming is the O-forming, shown in FIG. 2H. A width B13 of the final form 13 is then larger than the width B5 of the preform 5. In particular, the width B13 of the final form 13 is approximately equal to the width B11 of the intermediate form 11. In that context, a lower portion 14 of the intermediate form 11 preferably corresponds to the lower portion 14 of the final form 13. This allows the intermediate form 11 to be positioned and/or calibrated already on placing into the final forming tool 12. In that context, the height of the lower portion is preferably up to 25%, in particular up to 30% and particularly preferably up to 50% of the height of the final form 13 in the lower portion 14 in corresponding fashion.

FIGS. 2A and 2D-2H further show a respective wall thickness. The wall thickness wd essentially corresponds to the wall thickness wa of the billet 4. The wall thickness we also corresponds to the wall thickness wg and therefore to the wall thickness wa. If an intermediate forming step is now carried out from FIGS. 2E-2F, it is possible, even during this intermediate forming step, to increase the wall thickness by upsetting. It is possible to set a wall thickness wf that is greater than the wall thickness we. This can also take place only in certain length sections over the length of the preform that is to be produced. In this case, the wall thickness wg upon placing into the final forming tool would then correspond to the wall thickness wf. Thus, wg is greater than we. If the wall thickness is not upset in the intermediate forming step, or if the intermediate forming step is not carried out, the wall thickness wg corresponds to the wall thickness we. Now, it is also possible to carry out an upsetting operation during the final forming. The wall thickness wh of the produced component is then greater than the wall thickness wg. To that end, end faces 23 come to bear in a form-fitting manner, and when the tool is further closed for final forming the form-fitting bearing contact of the end faces 23 leads to upsetting and thus to the wall thickness increasing from wg to wh. Thus, the wall thickness wh is greater than the wall thickness wg.

Figure 3:
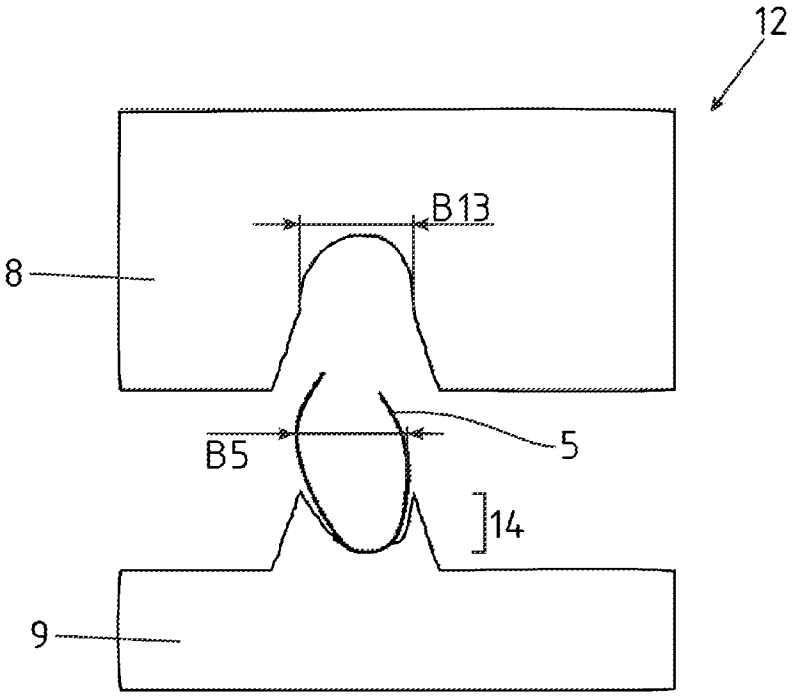
FIG. 3 shows a preform being placed into a final forming tool.

This is also shown again in FIG. 3, in which the preform 5 is placed here into the final forming tool 12 without an intermediate form 11. Here, too, the contour of a lower portion 14 of the preform 5, produced during U-forming, already approximates the final form 13, so that it is centered upon placing into the final forming tool 12.

Figure 4C:
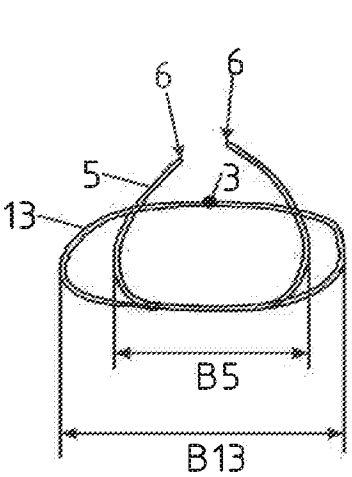
FIGS. 4A-4C show various superimposed cross-sectional representations of a preform and a final form.
Figure 4B:
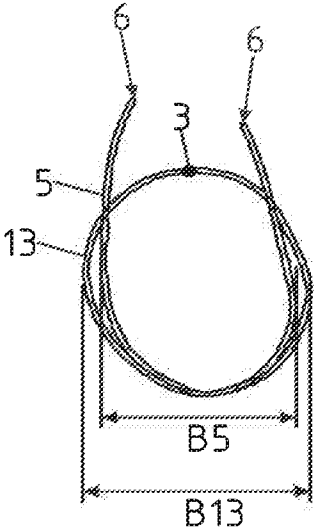
Figure 4A:
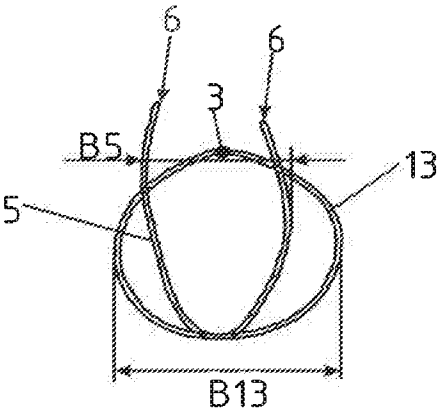

FIGS. 4A-4C clearly show here, once again, the production method according to some embodiments of the disclosure, in which, at various cross sections, the inner shape shows the U-shaped preform 5 as an open hollow profile and, corresponding thereto, the final form 13 produced after the O-forming. It is first clear that the respective maximum width B5 of the preform 5 is smaller, in particular sometimes much smaller, than the width B13 of the final form 13. The projecting edges 6 of the preform 5 can in each case be bent toward one another, which can be brought about by an intermediate forming process after preforming. The individual cross sections of the preform 5 also differ from one another with respect to size and shape thereof, just like the cross-sectional shapes of the resulting final form 13.

Figure 5A:
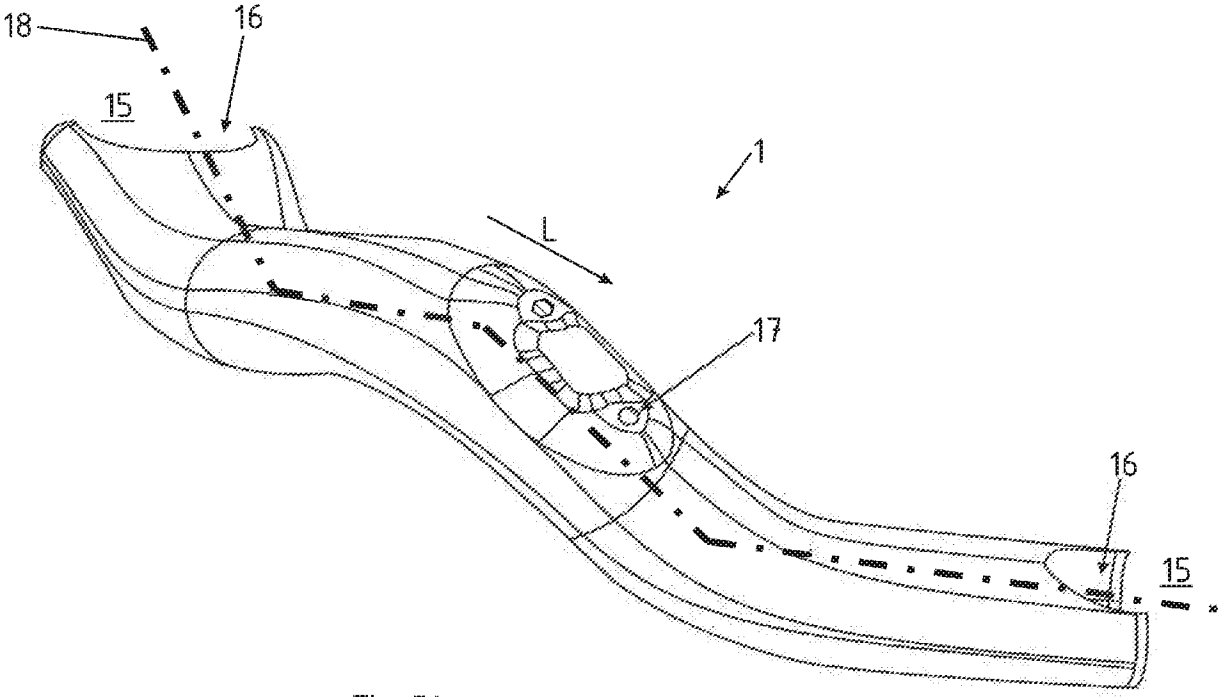
FIGS. 5A-5D show a component according to some embodiments of the disclosure with two mutually different curvatures, in a perspective view and two different side views.

FIG. 5A shows, in perspective view, a sheet metal component 1 produced according to some embodiments of the disclosure, also referred to below as the component 1. This is a side arm of an axle carrier. The shaped sheet metal part 1 has, over its longitudinal direction L, cross-sectional configurations that differ from one another. Furthermore, the shaped sheet metal part 1 has cutouts 16 at its ends 15, and a coupling region 17 in a central length section. The cutout 16 and the coupling region 17 are intended for coupling with other components, which are not shown in more detail.

Figure 5B:
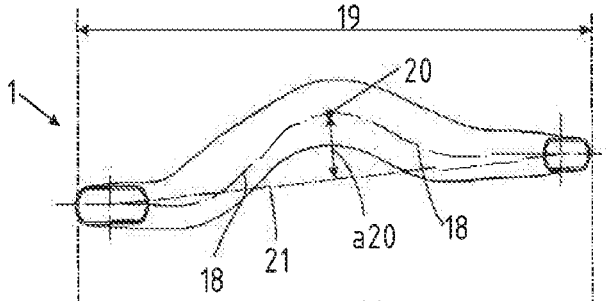
Figure 5C:
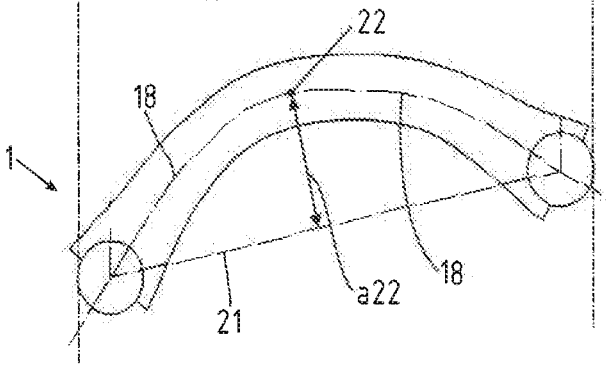
Figure 5D:
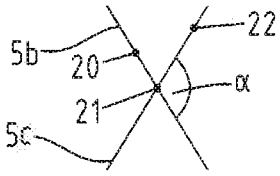

Another advantage according to some embodiments of the disclosure is already to be seen on the central longitudinal axis 18 of FIG. 5A. This advantage is shown again, and in greater detail, in FIGS. 5B-5C each showing a side view, from different viewpoints, of the shaped sheet metal part 1 shown in FIG. 5A. The shaped sheet metal part 1 has, over its longitudinal extent, curvatures in two directions. The maximum deflection 20, 22 (relative to the central longitudinal axis 18) of each of these curvatures is in each case in a plane with a straight line 21 connecting the ends 15. The two resulting planes are arranged at an angle α to one another. Thus, in contrast to the UO forming methods known from the prior art, the UO forming method according to some embodiments of the disclosure makes it possible to produce a component having not just one curvature in one direction, but also a second or further curvature(s) whose respective maximum deflection is in another direction, and the two directions or planes are arranged at an angle α, in particular of 90°, to one another. FIG. 5D shows the two planes containing the respective maximum deflection 20, 22 of the curvature, and the angle α therebetween.

Particularly preferably, it is further possible, with the method according to some embodiments of the disclosure, to set a ratio between the overall length 19 of the component 1 and the maximum deflection of the curvature. Thus, it is possible to set a deflection a20, a22 of the respective curvature between the central longitudinal axis 18 and a straight line 21 connecting the ends 15 at a ratio of at least 0.125. The ratio is preferably greater than 0.15, in particular greater than 0.2. However, the ratio in some embodiments does not exceed 0.8, in particular 0.5. This means that the maximum deflection a20, a22 corresponds in each case to at least 12.5% of the overall length 19 of the component 1. Thus, the method according to some embodiments of the disclosure markedly increases, compared to the prior art, the degrees of freedom for shaping, in particular in the case of a component 1 having a three-dimensionally complex form and curved in at least two directions.

FIGS. 6A-6E show the shaped sheet metal part 1 according to some embodiments of the disclosure, in a side view and in various cross-sectional views. FIGS. 6B-6E show cross-sectional views corresponding to the section lines B-B, C-C, D-D and E-E of FIG. 6A, respectively. These figures show clearly that, in the longitudinal direction L of the component 1, the respective cross sections differ from one another. Thus, the cross section varies. For example, the circumference U of the cross section in FIG. 6B is larger than the circumference U of the cross section in FIG. 6D, the cross section in FIG. 6E being larger again. It is also for example possible for the wall thickness Wd in FIG. 6D and the wall thickness We in FIG. 6E to be larger than the wall thicknesses Wc and Wb in FIGS. 6C and 6B. The wall thickness of the cross sections shown in FIGS. 6D-6E can be increased by an upsetting process during an intermediate forming step and/or during the final forming. As shown in FIGS. 6B-6C, the wall thickness can remain the same. It is however also possible for the wall thicknesses Wb, Wc, Wd and We to all be identical. The wall thickness is preferably constant in any given cross section.

The foregoing description of some embodiments of the disclosure has been presented for purposes of illustration and description. It is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A method of producing a shaped sheet metal part from a billet by UO forming, said method comprising:

creating a preform from the billet by U-forming; then performing intermediate forming, wherein the intermediate forming comprises at least one of curling the preform, or upsetting the preform in a cross section so as to increase a wall thickness of the preform in the cross section; and then performing final forming to shape the preform into the shaped sheet metal part by O-forming, wherein the preform has, in the cross section, a maximum width that is smaller than a maximum width of a cross section of the shaped sheet metal part produced after the O-forming.

2. The method according to claim 1, wherein the shaped sheet metal part is produced with a cross section that is not constant in a longitudinal direction of the shaped sheet metal part.

3. The method according to claim 1, wherein the maximum width of the cross section of the preform is smaller than the maximum width of the cross section of the shaped sheet metal part by at least 5%.

4. The method according to claim 1, further comprising:

bending projecting edges of the preform inward during or after the U-forming.

5. The method according to claim 1, further comprising:

during the final forming, upsetting the part to be produced in the cross section, so as to increase a wall thickness of the part in the cross section.

6. The method according to claim 1, further comprising:

trimming projecting edges of the preform after said creating the preform.

7. The method according to claim 1, wherein at least the O-forming comprises hot-forming.

8. The method according to claim 7, wherein the O-forming further comprises press quenching subsequent to the hot-forming.

9. The method according to claim 1, wherein, during the creating, the preform is produced with the cross section that is not constant in a longitudinal direction of the preform.

10. The method according to claim 1, wherein the maximum width of the cross section of the preform is smaller than the maximum width of the cross section of the shaped sheet metal part by at least 20%.

11. The method according to claim 1, wherein at least a lower quarter of a cross section of an intermediate form produced during the curling deviates by less than 10% from the cross section of the shaped sheet metal part.

12. The method according to claim 1, wherein at least a lower half of a cross section of an intermediate form produced during the curling corresponds to the cross section of the shaped sheet metal part.

13. The method according to claim 1, wherein during the curling, the maximum width of the preform is widened to the maximum width of the shaped sheet metal part.

14. A method of producing a shaped sheet metal part from a billet by UO forming, said method comprising:

creating a preform from the billet by U-forming; then curling the preform; and then performing final forming to shape the preform into the shaped sheet metal part by O-forming, and wherein during the curling, a maximum width of a cross section of the preform is widened to a maximum width of a cross section of the shaped sheet metal part produced after the O-forming.

* * * * *